US009071003B2

(12) United States Patent
Lindkamp

(10) Patent No.: US 9,071,003 B2
(45) Date of Patent: Jun. 30, 2015

(54) PLUG-IN CONNECTOR FOR HIGH DATA TRANSMISSION RATES

(75) Inventor: Marc Lindkamp, Luebbecke (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 131 days.

(21) Appl. No.: 13/997,431

(22) PCT Filed: Oct. 19, 2011

(86) PCT No.: PCT/DE2011/075253

§ 371 (c)(1),
(2), (4) Date: Jun. 24, 2013

(87) PCT Pub. No.: WO2012/083939

PCT Pub. Date: Jun. 28, 2012

(65) Prior Publication Data

US 2013/0273766 A1 Oct. 17, 2013

(30) Foreign Application Priority Data

Dec. 22, 2010 (DE) ..... 10 2010 055 851

(51) Int. Cl.

| | |
|---|---|
| ***H01R 13/625*** | (2006.01) |
| ***H01R 13/516*** | (2006.01) |
| ***H01R 13/50*** | (2006.01) |
| ***H01R 13/627*** | (2006.01) |
| ***H01R 13/66*** | (2006.01) |

(52) U.S. Cl.

CPC ..... *H01R 13/516* (2013.01); *H01R 13/50* (2013.01); *H01R 13/6275* (2013.01); *H01R 13/6658* (2013.01)

(58) Field of Classification Search

CPC ..... H01R 13/639; H01R 13/3695; H01R 13/6275; H01R 13/62; H01R 13/627; H01R 13/6272

USPC ..... 439/345, 354, 358, 357

See application file for complete search history.

(56) References Cited

U.S. PATENT DOCUMENTS

| | | | | |
|---|---|---|---|---|
| 7,052,306 | B2 * | 5/2006 | Ishigami et al. | 439/372 |
| 7,090,523 | B2 * | 8/2006 | Shirk et al. | 439/352 |
| 7,160,136 | B2 * | 1/2007 | Zhang et al. | 439/357 |
| 7,163,412 | B2 * | 1/2007 | Fan et al. | 439/258 |
| 7,255,587 | B2 * | 8/2007 | Boeck et al. | 439/358 |
| 7,261,582 | B2 * | 8/2007 | Wu | 439/352 |
| 7,351,090 | B1 * | 4/2008 | Moore | 439/372 |
| 7,410,365 | B2 * | 8/2008 | Wu | 439/76.1 |
| 7,416,433 | B1 * | 8/2008 | Wu | 439/372 |

(Continued)

FOREIGN PATENT DOCUMENTS

EP 2224552 9/2010

*Primary Examiner* — Abdullah Riyami
*Assistant Examiner* — Vladimir Imas
(74) *Attorney, Agent, or Firm* — Jacobson Holman, PLLC.

(57) ABSTRACT

A so-called QSFP-plug-in connector is suggested for high performance-plug-in connections in data centers, which comprises a one-piece metallic exterior housing and in which a one-piece locking device is embodied, which via a latch attached thereat can be released from an appropriately embodied cage-like counter connector.

Figure 1:
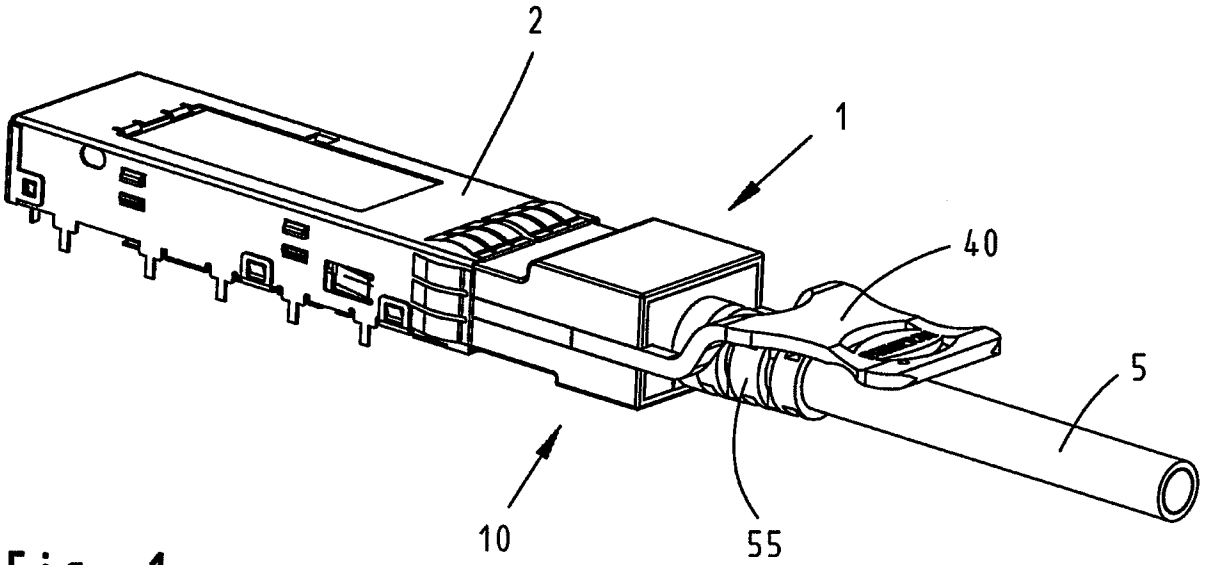

Here, a circuit board is provided for the direct plug-in connection in copper-based twin-axial cable connections which is connected inside the exterior housing with electric conductors arranged therein. The electric conductors are held in axially aligned grooves via a fixing clip encompassing them.

3 Claims, 6 Drawing Sheets

(56) References Cited

U.S. PATENT DOCUMENTS

| | | | | |
|---|---|---|---|---|
| 7,429,185 | B1 * | 9/2008 | Wu | 439/372 |
| 7,445,485 | B1 * | 11/2008 | Wu | 439/352 |
| 7,540,755 | B1 * | 6/2009 | Wu | 439/352 |
| 7,578,695 | B2 * | 8/2009 | Boeck et al. | 439/463 |
| 7,621,770 | B1 * | 11/2009 | Finizio et al. | 439/354 |
| 7,651,342 | B1 * | 1/2010 | Wu | 439/76.1 |
| 7,771,225 | B1 * | 8/2010 | Wu | 439/352 |
| 7,780,466 | B1 * | 8/2010 | Wu | 439/354 |
| 7,803,010 | B1 * | 9/2010 | Hwang | 439/497 |
| 7,824,208 | B2 * | 11/2010 | Crofoot et al. | 439/352 |
| 7,841,889 | B2 * | 11/2010 | Gerard et al. | 439/358 |
| 7,891,986 | B2 * | 2/2011 | Wu | 439/76.1 |
| 7,901,226 | B2 * | 3/2011 | Kotaka | 439/160 |
| 7,972,150 | B1 * | 7/2011 | Lin | 439/88 |
| 8,035,975 | B2 * | 10/2011 | Wu | 361/747 |
| 8,388,366 | B2 * | 3/2013 | Yang | 439/357 |
| 8,393,913 | B2 * | 3/2013 | Wu | 439/345 |
| 8,444,430 | B2 * | 5/2013 | Kappla et al. | 439/352 |
| 8,537,558 | B2 * | 9/2013 | Su et al. | 361/747 |
| 8,562,369 | B2 * | 10/2013 | Wu | 439/345 |
| 8,770,990 | B2 * | 7/2014 | Sytsma et al. | 439/76.1 |
| 8,787,025 | B2 * | 7/2014 | Wu | 361/740 |
| 8,905,777 | B2 * | 12/2014 | Zhu et al. | 439/352 |
| 2006/0199434 | A1 * | 9/2006 | Chang | 439/610 |
| 2009/0247017 | A1 * | 10/2009 | Wu | 439/660 |
| 2010/0203754 | A1 * | 8/2010 | Li et al. | 439/345 |
| 2011/0136368 | A1 * | 6/2011 | Wu | 439/345 |
| 2011/0300749 | A1 * | 12/2011 | Sytsma et al. | 439/607.01 |
| 2012/0015544 | A1 * | 1/2012 | Wu | 439/345 |
| 2012/0040552 | A1 * | 2/2012 | Wu | 439/358 |
| 2012/0064779 | A1 * | 3/2012 | Wu | 439/676 |
| 2013/0231011 | A1 * | 9/2013 | Sytsma et al. | 439/723 |

* cited by examiner

PLUG-IN CONNECTOR FOR HIGH DATA TRANSMISSION RATES

This is a national stage of PCT/DE11/075253 filed Oct. 19, 2011 and published in German, which has a priority of German no. 10 2010 055 851.6 filed Dec. 22, 2010, hereby incorporated by reference.

DESCRIPTION

The invention relates to a plug-in connector according to the preamble of claim 1.

Such a so-called QSPF-plug-in connector is required in order to transmit signals with high data rates, for example in the Ethernet. Here, the data rates desired range from 40 Gb/s to 100 Gb/s, with initially only passive, twin-axial cable connections are considered for connections with a minimum length of 10 m in order to connect for example switches or computing units located in a cabinet in a computing center or a switch board.

PRIOR ART

From U.S. Pat. No. 7,445,485 B1 a plug-in module is known for high-speed data transmissions, which is made from a rather expensively produced plug-in cover comprising several components with a locking mechanism, with the locking of the plug-in module can be unlocked via a pull tape.

From EP 2 224 552 A2 an electric plug-in connector is known, comprising a two-part housing, at which an unlocking mechanism is provided. Inside the housing individual conductors of an electric cable are fastened at a circuit board, which are provided for the direct contacting with a counter plug-in connector. The individual conductors of the electric cable are molded-in to ensure the fastening of the conductors at the circuit board.

OBJECTIVE

The invention is therefore based on the objective to provide a connector body that can be easily produced as well as an easier handling of the electric conductors to be inserted or connected in the plug-in connector.

This objective is attained in the characterizing features of the independent claim 1.

Advantageous embodiments of the invention are shown in the dependent claims.

The invention relates to plug-in connectors used in the range of 10-100 Gigabit-Ethernet.

Such plug-in connectors are designed extremely sleek, with either fiberglass or copper wire being provided as the transmission medium.

The passive copper wires are advantageous by their lower power consumption in reference to the fiber-optic variants which are also used in this field.

The plug-in side of this so-called QSFP plug-in connector (QSFP=Quad Small Formfactor Pluggable) comprises here a plug-in circuit board, on which up to 38 electric conductors are to be connected and/or soldered above and below the circuit board, showing a distance of the circuit paths amounting to 0.8 mm with soldering areas showing a width of 0.6 mm.

The plug-in connector housings are metallically insulating and equipped with a locking mechanism, which may be operated via a pull loop provided at the side of the cable connection.

Such a plug-in connector is plugged into a so-called cage—a cage-like, shielding counter connector, which in turn is designed generally inside a housing for switches, routers, or bus-adapters—thus in equipment of the Ethernet field, installed directly on the circuit boards. With the plug-in connectors here can be inserted into openings of a respective housing, arranged side-by-side, and there immediately lock automatically.

The advantages achieved with the invention particularly comprise that the connector housing is produced as a one-piece housing in which additionally required parts, such as a fastening frame embodied as a cable manager are arranged at the circuit board provided for the direct plug-in connection to be connected to the individual conductors.

Additionally, a spring-loaded locking mechanism is integrated with a pull latch to unlock counter-connectors as well as a cable anti-kink protection.

Here, it is particularly advantageous that the locking device, unlike prior art, is arranged inside the connector housing so that parts of the locking mechanism otherwise located at the outside require no bending.

The cable manager proves particularly advantageous for the fixation of the electric conductors, representing a considerable simplification during the assembly and for the soldering process of the individual conductors on the circuit board.

The cable manager is embodied in a planar design with grooves aligned axially side-by-side, in which the individual electric conductors are to be inserted, which subsequently are to be fixed with a clip so that the ends of the conductors directly rest on the solder pads in order to be soldered to the circuit board.

In prior art this process has occurred among other things via an adhesion of all individual conductors on an appropriately embodied frame.

While the plug-in face of the plug-in connector, with the circuit board arranged between two housing projections for the protection of the plug-in side, is produced according to the specifications of IEEE 802.3ba 40 GBASE SR4.

EXEMPLARY EMBODIMENT

Figure 2:
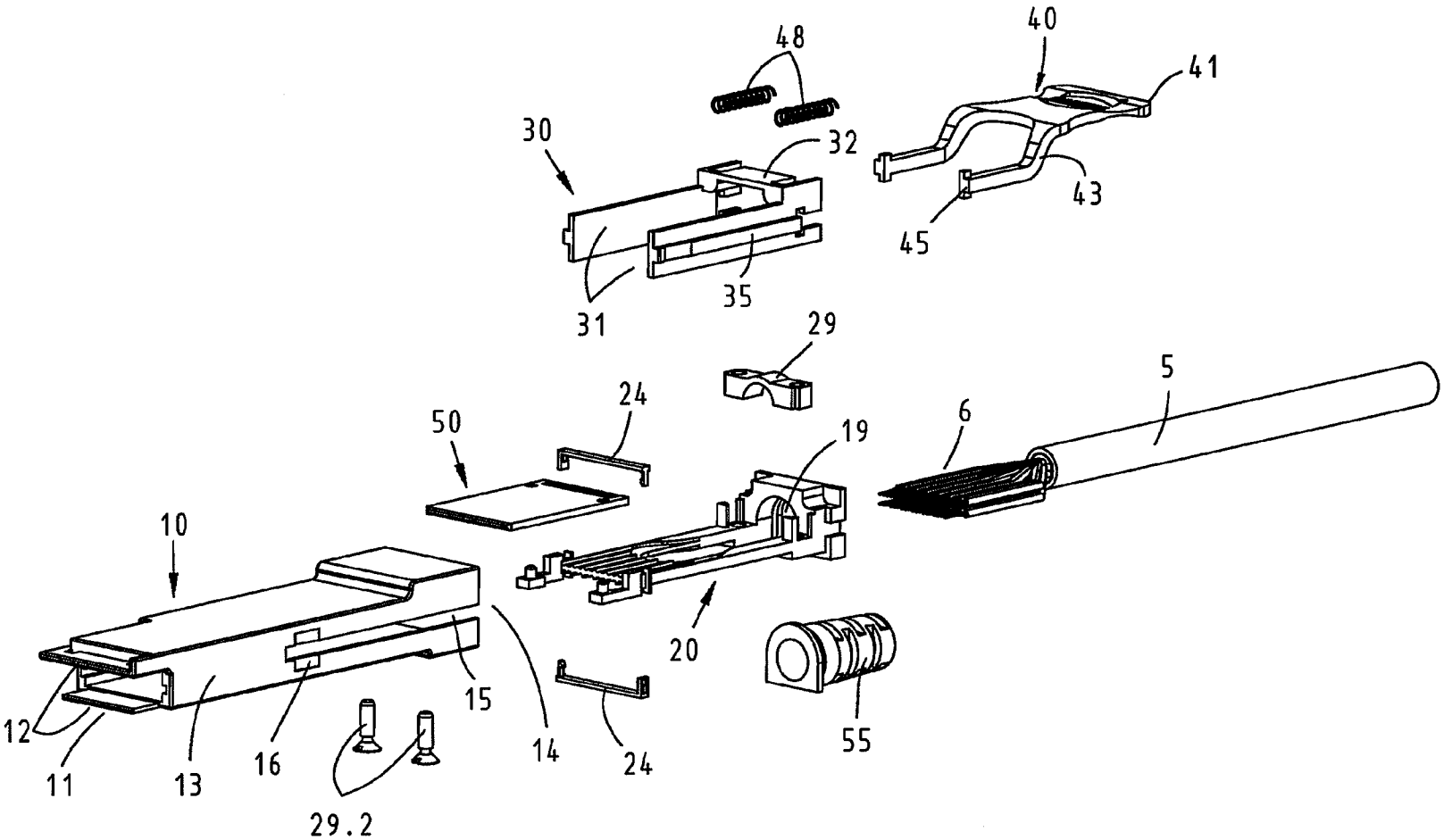
Figure 3:
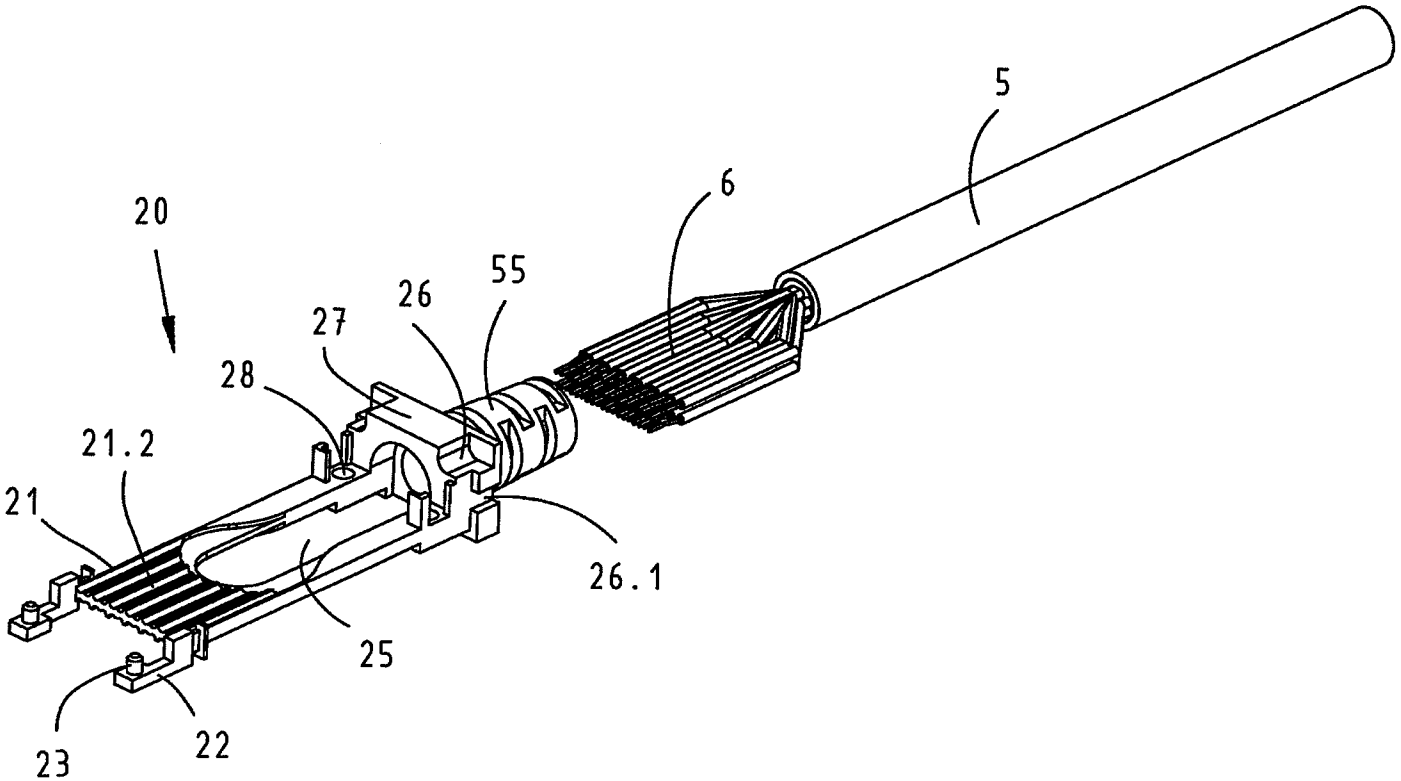
Figure 4:
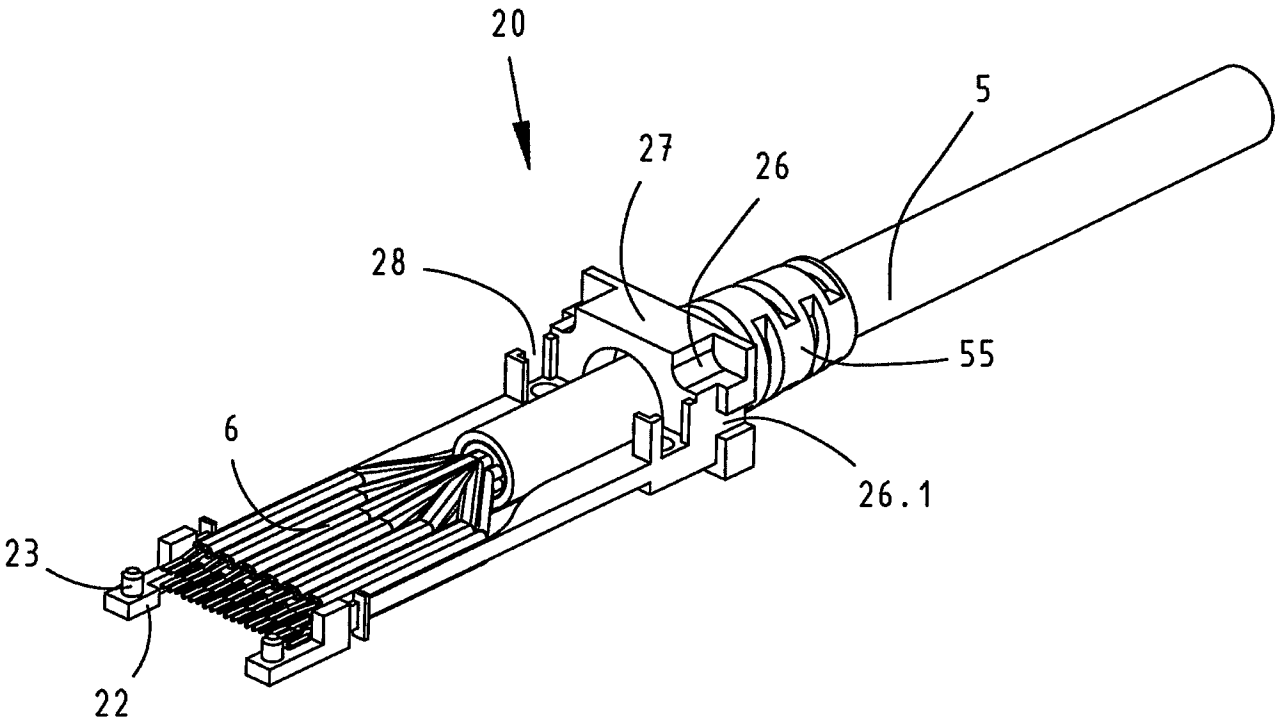
Figure 5:
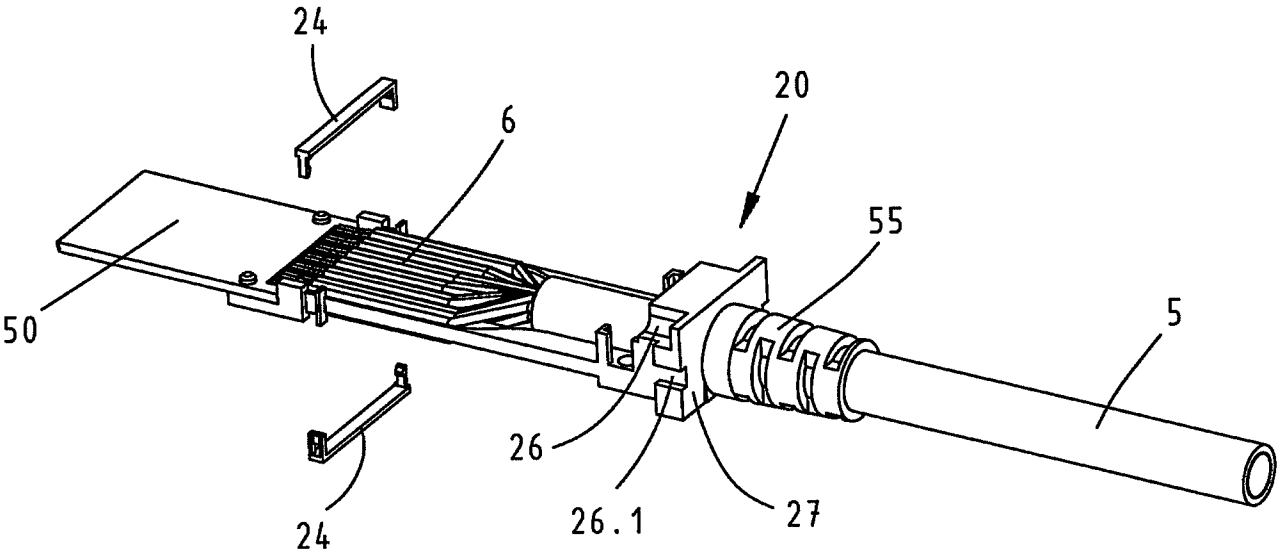
Figure 6:
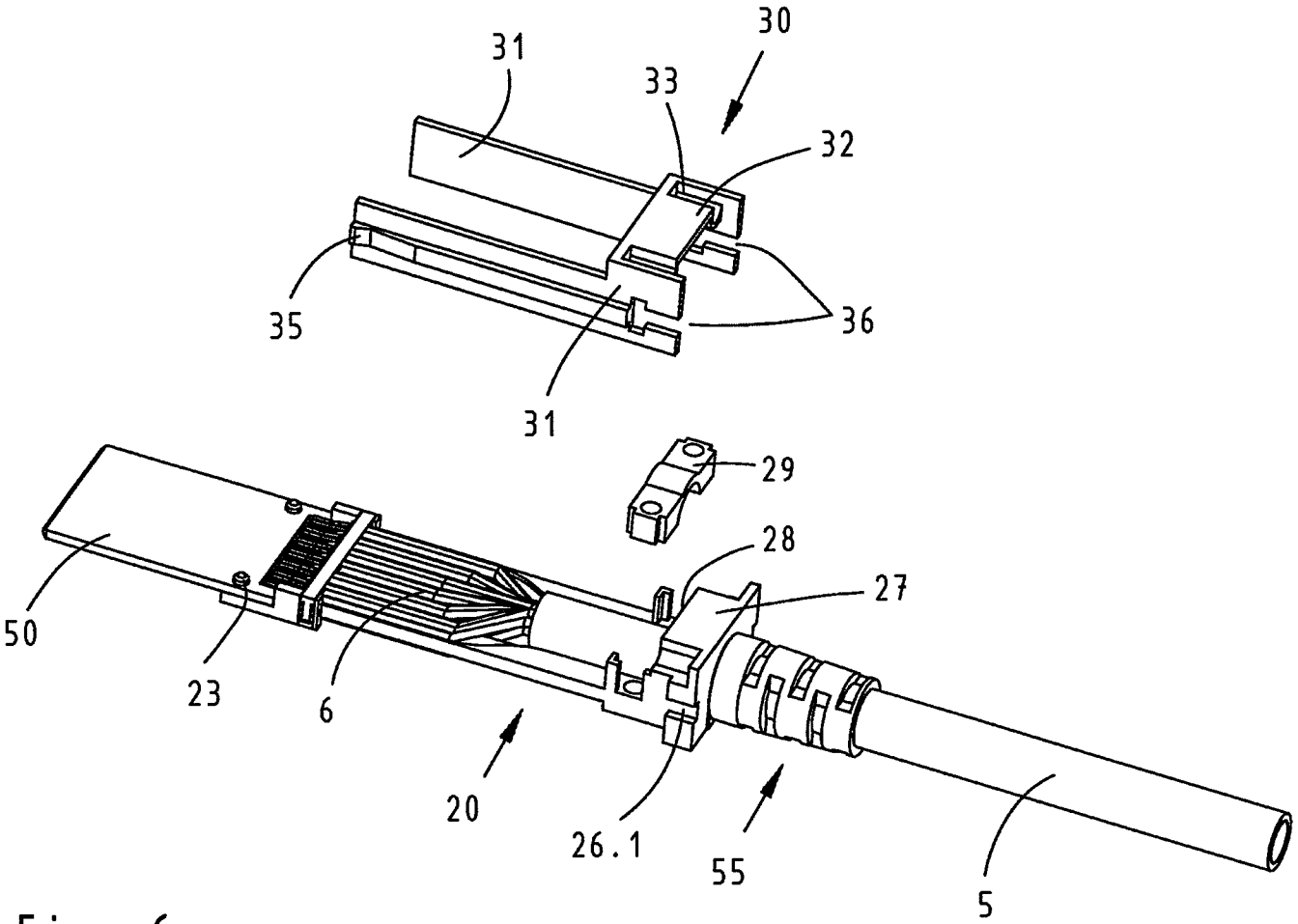

The drawing shows an exemplary embodiment of the invention and is explained in greater detail in the following. It shows:

FIG. 1 a plug-in connector according to the invention, plugged in a cage-like counter connector;

FIG. 2 an exploded illustration of a plug-in connector;

FIG. 3 a fastening frame with an electric cable;

FIG. 4 a fastening frame with electric conductors resting thereon;

FIG. 5 an assembled combination of a fastening frame, circuit board, and electric conductors;

FIG. 6 the assembled combination of FIG. 5 with a locking device;

FIG. 1 shows a plug-in connector 1 according to the invention, which comprises a one-piece exterior housing 10 made in an injection-molding process, including g a locking device 30, as well as a fastening frame 20 with a circuit board 50, which is arranged with its plug-in side 51 between two housing projections 12 each defining the width of the exterior housing.

For this purpose, a respective cage-like counter connector 2 is shown, with the plug-in connector 1 being inserted therein.

Here, the design and dimensions of the plug-in side are predetermined by standards, though.

FIG. 2 shows the plug-in connector 1 in its entirety with its individual parts in an exploded illustration. The exterior housing 10 of the plug-in connector 1 is formed in one piece, showing a plug-in side 11 and a cable connection side 14, with respectively a slot 15 being provided in both narrow lateral walls 13, in which the locking device 30 is arranged in an axially displaceable fashion.

Furthermore, a fastening frame 20 is shown, at which the circuit board 50 is mounted, which shows the respective contact sections, contacted by the ends of the individual electric conductors 6, with for this purpose the individual conductors 6 must be inserted into grooves 21 provided for this purpose, and via two fixing clips 24 opposite the inserted plug-in side 11, an unlocking latch 40 is provided on the cable connection side 14 by which the locking to the counter connector 2, automatically occurs during the plug-in process, can be released again. Furthermore, a cable 5, fastened inside the plug-in connector 1, may be sectionally surrounded by a cable kink protection 55.

The operating sequence to assemble the plug-in connector 1 is disclosed in FIGS. 3, 4, 5.

Firstly, the cable kink protection 55 is pushed over the cover of the cable 5, subsequently the individual electric conductors 6 are exposed, and slightly fanned according to their arrangement above and below the assembly area 21 of the fastening frame 20. Then the cable 5 with the cable kink protection 55 is inserted into the cable conduit of the rear wall 27 and the cable 5 is fastened with the cable clamp 29. After the grooves 21.2 have been configured with the respective individual conductors 6 they can be fastened via fixing clips 24 above and below the assembly area 21, in order to subsequently solder the insulated ends of the individual conductors 6 being soldered on the circuit board 50.

An oblong, oval opening 25 in the fastening frame 20 is discernible from FIG. 3, with a flat assembly area 21, extending over the width of the fastening frame 20, following grooves 21.2 arranged side-by-side in the direction towards the plug-in side.

Here the grooves 21.2 are formed at both sides of the assembly area 21 of the fastening frame 20.

FIG. 4 shows the fastening frame 20 with the already assembled cable kink protection 55 at the cable connection side 14 and an individual electric conductor 6 already arranged side-by-side in the grooves 21.

In FIG. 5 the two fixing clips 24 are added so that in FIG. 6 the ends of the electric conductors can be soldered to the circuit board.

Firstly the fastening frame 20 is provided together with the circuit board 50 for an assembly of the individual electric conductors 6 on the circuit board 50 outside the housing in order to subsequently be pushed into the exterior housing 10. Here it must be observed that the electric conductors 6 are to be contacted at both sides of the circuit board 50.

The circuit board 50 is fixed during the assembly in bore holes provided for this purpose in the front plug-in section of the fastening frame 20 via fastening pins 23 formed at a fastening device 22. The circuit board 50 with its printed circuit paths on the plug-in side 11 represents the direct contacting to corresponding contacts of the counter connector 2.

With the assembly of the circuit board 50 at the fastening frame 20 the cable 5 can be fixed in the area of the rear wall 27 of the fastening frame 20 via a cable clamp 29 (see FIG. 6), to be inserted in an insert gap 28.

A spring 48 is respectively inserted in this recess 33, which always applies a pressure from the rear wall 27 upon the locking device 30. This causes a mandatory locking of the plug-in connector 1 when it is inserted into the cage-like counter connector 2.

During the assembly of the plug-in connector 1 the exterior housing 10 is pushed onto the assembled unit up to the rear wall 27 of the fastening frame 20 and subsequently screwed via two fastening screws 29.2, guided through the exterior housing 10 and respective bores, not shown, in the fastening frame 20 to the interior cable clamp 29.

Here, only the unlocking latch 40 with the locking device 30 remains able to be shifted.

This composition with the fastening of the cable 5 in the opening of the rear wall 27 of the fastening frame 20 and/or more precisely inside the cable kink protection 55, the additional fixation via the cable clamp 29 as well as the circuit board 50 attached to the fastening frame 20 via fastening pins 23 leads to an overall extremely stable construction, which only needs to be inserted into the exterior housing 10 together with the locking device 30 in order to be fixed with the two fastening screws 29.2.

LIST OF REFERENCE CHARACTERS

1 Plug-in connector in its entirety
2 Counter connector, cage-like
5 Cable
6 Individual electric conductor
10 Exterior housing
11 Plug-in side
12 Housing projection
13 Lateral wall
14 Cable connection side
15 Slot, at both sides
16 Recess, square, diagonal
17 Latching edge
18 Extension of the slot
19 Passage for kink protection+cable
20 Fastening frame (cable manager)
21 Assembly area for the individual electric conductors
21.2 Grooves for individual conductors
22 Fastening device with
23 Fastening pins for circuit board 50
24 Fixing clip for individual conductors
25 oblong recess, opening for cable 5
26 Recess for pressure spring 48
26.1 Recess in 20 for 43
27 Rear wall with cable conduit
28 Insert for cable clamp
29 Cable clamp
29.2 Fastening screws for 29
30 Locking device
31 Lateral legs, two
32 Bar therebetween
33 Recess, for spring
35 Prims bar in the housing slot 15
36 Recess for 45, 43
37 Unlocking hook
38 Wall incline, aligned inwardly
40 Unlocking latch
41 Pull section
43 Pull arms
45 Locking hooks for 36
48 Pressure spring
50 Circuit board
55 Cable kink protection

The invention claimed is:

1. A plug-in connector (1) for lockable and unlockable engagement with a counter connector (2), the counter connector having electrical contacts therewithin, wherein said plug-in connector (1) comprises an exterior housing (10) defining an open plug-in side (11) for engagement with the counter connector (2) and a cable connector side (14) for receiving an electric cable (5) having a plurality of individual conductors (6), a locking mechanism (30) within said exterior housing (10) for lockable engagement with the counter connector (2), a fastening frame (20) within said exterior housing (10) extending between the open plug-in side and the cable connector side, said fastening frame (20) defining a cable manager formed by a plurality of longitudinal grooves (21) to receive the plurality of individual conductors in a side-by-side relationship, a fixing clip (24) arranged transversely to said longitudinal grooves (21) to hold the individual conductors within the longitudinal grooves and adjacent to a circuit board (50), said individual conductors connected to said circuit board (50), said circuit board connected to said fastening frame (20) and extending into the open plug-in side of said exterior housing (10) for making direct contact with the electrical contacts of the counter connector (2) when the exterior housing (10) is in lockable engagement with the counter connector (2), and an unlocking latch (40) extending outwardly from the exterior housing (10) and manually shiftable to unlock the exterior housing (10) from the counter connector (2).

2. The plug-in connector according to claim 1, wherein the exterior housing (10) is secured to the fastening frame (20) and the locking device (30) via fastening screws (29.2) and a cable clamp (29).

3. The plug-in connector according to claim 1, wherein the exterior housing (10) is embodied in one piece, the fastening frame (20) is embodied in one piece, and the locking device (30) is embodied in one piece.

* * * * *